US010980699B2

(12) United States Patent
Komatsu et al.

(10) Patent No.: US 10,980,699 B2
(45) Date of Patent: Apr. 20, 2021

(54) WALKING ASSISTANCE APPARATUS AND CONTROL METHOD

(71) Applicant: Panasonic Intellectual Property Management Co., Ltd., Osaka (JP)

(72) Inventors: Mayumi Komatsu, Kyoto (JP); Stephen William John, Nara (JP); Kenta Murakami, Osaka (JP); Jun Ozawa, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 218 days.

(21) Appl. No.: 16/137,648

(22) Filed: Sep. 21, 2018

(65) Prior Publication Data

US 2019/0021936 A1 Jan. 24, 2019

Related U.S. Application Data

(63) Continuation of application No. PCT/JP2017/019868, filed on May 29, 2017.

(30) Foreign Application Priority Data

Jun. 30, 2016 (JP) ..... JP2016-129568
Mar. 14, 2017 (JP) ..... JP2017-048835

(51) Int. Cl.
*A61H 3/00* (2006.01)
*A61H 1/00* (2006.01)
*A61H 1/02* (2006.01)

(52) U.S. Cl.
CPC ..... *A61H 3/00* (2013.01); *A61H 1/00* (2013.01); *A61H 1/0244* (2013.01);
(Continued)

(58) Field of Classification Search
CPC ..... A61H 3/00; A61H 1/00; A61H 1/0244; A61H 1/0262; A61H 2201/5007;
(Continued)

(56) References Cited

U.S. PATENT DOCUMENTS

2013/0288863 A1 10/2013 Yamamoto et al.
2015/0173993 A1* 6/2015 Walsh ..... A61F 2/68 414/4

(Continued)

FOREIGN PATENT DOCUMENTS

CN 104008398 8/2014
CN 105263448 1/2016

(Continued)

OTHER PUBLICATIONS

International Search Report of PCT application No. PCT/JP2017/019868 dated Aug. 8, 2017.

(Continued)

*Primary Examiner* — Victoria Murphy
*Assistant Examiner* — Arielle Wolff
(74) *Attorney, Agent, or Firm* — Wenderoth, Lind & Ponack, L.L.P.

(57) ABSTRACT

A walking assistance apparatus includes a suit to be worn on a knee and waist of a user, a first wire that couples a portion included in the suit and worn above the knee to a portion included in the suit and worn on the waist, a second wire that couples a portion included in the suit and worn above a back of the knee to a portion included in the suit and worn on the waist, and motors coupled to the first and second wires. The motors are controlled to generate tensions so that each of the first and second wires has a stiffness greater than 200 N/m during a first period including a period of 95% or more and 100% or less of a first gait cycle of the user and a period of (Continued)

0% or more and 50% or less of a second gait cycle subsequent to the first gait cycle.

10 Claims, 12 Drawing Sheets

(52) U.S. Cl.
CPC ..... *A61H 1/0262* (2013.01); *A61H 2003/007* (2013.01); *A61H 2201/1207* (2013.01); *A61H 2201/1215* (2013.01); *A61H 2201/14* (2013.01); *A61H 2201/163* (2013.01); *A61H 2201/164* (2013.01); *A61H 2201/165* (2013.01); *A61H 2201/1642* (2013.01); *A61H 2201/1657* (2013.01); *A61H 2201/1671* (2013.01); *A61H 2201/50* (2013.01); *A61H 2201/5007* (2013.01); *A61H 2201/5061* (2013.01); *A61H 2201/5069* (2013.01); *A61H 2201/5071* (2013.01); *A61H 2201/5097* (2013.01)

(58) Field of Classification Search
CPC ..... A61H 2201/5097; A61H 2201/14; A61H 2201/50; A61H 2201/1642; A61H 2201/1215; A61H 2201/1657; A61H 2201/163; A61H 2003/007; A61H 2201/1207; A61H 2201/164; A61H 2201/165; A61H 2201/1671; A61H 2201/5061; A61H 2201/5069; A61H 2201/5071; A61H 1/02; A61H 1/0237; A61H 1/024; A61H 1/0255; A61H 1/0259; A61H 1/0266; A61H 2001/0211; A61H 2201/12; A61H 2201/1652; A61H 2201/5046; A61H 2201/149; A61H 2201/5012; A61H 2201/5084; A61H 5/1125; A61H 2201/5025; A61H 2201/5035; A61H 2201/5079; A61H 2201/5023; A61H 2201/0192; A61H 2201/1238; A61H 2201/5028; A61H 2205/10; A61H 2203/007; A61B 5/1125; A61B 5/1038; A61B 5/112; A61B 2562/0219; A61B 2562/0257; A61B 2505/09

See application file for complete search history.

(56) References Cited

U.S. PATENT DOCUMENTS

| | | | |
|---|---|---|---|
| 2015/0321339 | A1 | 11/2015 | Asbeck et al. |
| 2016/0107309 | A1 | 4/2016 | Walsh et al. |
| 2016/0150999 | A1 | 6/2016 | Sugata |
| 2016/0235615 | A1 | 8/2016 | Yamamoto et al. |
| 2017/0202724 | A1 | 7/2017 | De Rossi et al. |

FOREIGN PATENT DOCUMENTS

| | | |
|---|---|---|
| JP | 2015-529574 | 10/2015 |
| JP | 2016-049122 | 4/2016 |
| JP | 2016-104057 | 6/2016 |
| JP | 2016-528940 | 9/2016 |
| WO | 2011/078104 | 6/2011 |
| WO | 2012/124328 | 9/2012 |

OTHER PUBLICATIONS

English Translation of Search Report dated Jul. 31, 2020 in Chinese Application No. 201780009168.0.

* cited by examiner

| GAIT PHASE (%) | TARGET TORQUE (N/m) |
|---|---|
| 0 | -10 |
| 10 | -8.6 |
| 30 | 0 |
| 50 | 8 |
| 60 | 10 |
| 80 | 0 |
| 100 | -10 |

WALKING ASSISTANCE APPARATUS AND CONTROL METHOD

BACKGROUND

1. Technical Field

The present disclosure relates to a walking assistance apparatus for assisting in walking activities and a control method.

2. Description of the Related Art

International Publication No. 2012/124328 discloses a joint movement assistance device for assisting in flexing and extending of hip joints. The joint movement assistance device disclosed in International Publication No. 2012/124328 includes an assistant force transmission band extending across a hip joint, a first attachment unit located at an end of the assistant force transmission band, and a second attachment unit located at another end of the assistant force transmission band.

SUMMARY

No discussion has been made so far of when to assist in walking for more effective walking assistance.

In one general aspect, the techniques disclosed here feature a walking assistance apparatus including a suit to be worn on a knee and a waist of a user, a first wire that couples a portion that is included in the suit and worn above the knee of the user to a portion that is included in the suit and worn on the waist of the user, a second wire that couples a portion that is included in the suit and worn above a back of the knee of the user to a portion that is included in the suit and worn on the waist of the user, and motors coupled to the first wire and the second wire. The motors and the first wire and the second wire are in a one-to-one relationship. The motors generate tensions in the first wire and the second wire so that each of the first wire and the second wire has a stiffness greater than 200 N/m during a first period. The first period includes (i) a period of 95% or more and 100% or less of a first gait cycle of the user and (ii) a period of 0% or more and 50% or less of a second gait cycle subsequent to the first gait cycle, the first gait cycle and the second gait cycle being consecutive.

According to an aspect of the present disclosure, it is possible to more effectively assist in walking.

It should be noted that general or specific aspects may be implemented as a system, a method, an integrated circuit, a computer program, a computer-readable recording medium, or any selective combination thereof. The computer-readable recording medium includes, for example, a non-volatile recording medium such as a compact disc-read only memory (CD-ROM).

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
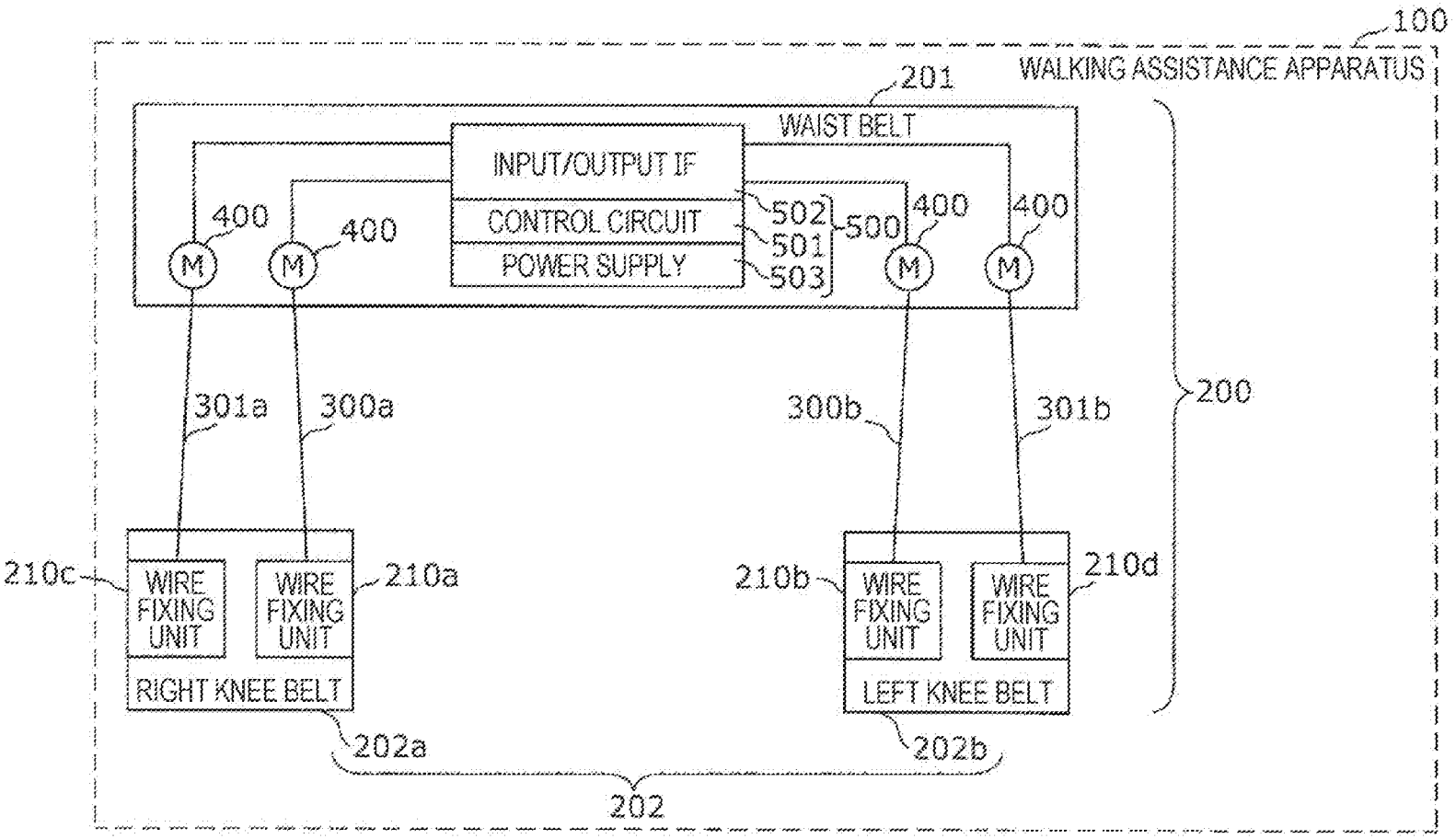
FIG. 1 illustrates a configuration of a walking assistance apparatus according to an embodiment.

There are two muscular functions to give action to the joints of a person. One of them is a function of generating torque around joints to develop dynamic movement, and the other one is a function of developing stiffness so as to perform static movement, that is, keeping proper footing.

Existing walking assistance apparatuses are intended to assist in the function of generating torque around joints among the muscular functions, and no discussion has been made of assistance in providing the function of developing stiffness.

Accordingly, walking assistance apparatuses have been being studied which include motors and wires for generating tensile forces at both the front and back sides of the hip joints of a person to assist in developing the stiffness of the hip joints of the person, thereby assisting the person in walking.

A walking assistance apparatus according to an aspect of the present disclosure includes a suit to be worn on a knee and a waist of a user, a first wire that couples a portion that is included in the suit and worn above the knee of the user to a portion that is included in the suit and worn on the waist of the user, a second wire that couples a portion that is included in the suit and worn above a back of the knee of the user to a portion that is included in the suit and worn on the waist of the user, and motors coupled to the first wire and the second wire. The motors and the first wire and the second wire are in a one-to-one relationship. The motors generate tensions in the first wire and the second wire so that each of the first wire and the second wire has a stiffness greater than 200 N/m during a first period. The first period includes (i) a period of 95% or more and 100% or less of a first gait cycle of the user and (ii) a period of 0% or more and 50% or less of a second gait cycle subsequent to the first gait cycle, the first gait cycle and the second gait cycle being consecutive.

According to the aspect described above, the walking assistance apparatus enhances the stiffness of the wires (the first wire and the second wire) during the first period to assist the user in supporting their weight with their leg that is in contact with the ground. This configuration can comparatively easily assist the user in supporting their weight during walking. The walking assistance apparatus can thus more effectively assist in walking.

For example, the walking assistance apparatus may further include a control circuit. The control circuit may acquire the first gait cycle and the second gait cycle, and output control signals to the motors for generating the tensions.

According to the aspect described above, the control circuit outputs control signals to the motors, thus allowing the walking assistance apparatus to assist the user in walking based on a more specific configuration.

For example, the motors may generate the tensions by winding or unwinding the first wire and the second wire.

According to the aspect described above, the motors wind or unwind the wires, thus allowing the walking assistance apparatus to assist the user in walking based on a more specific configuration.

For example, the motors may generate tensions in the first wire and the second wire so that each of the first wire and the second wire has a stiffness less than or equal to 200 N/m during a second period of 50% or more and 95% or less of the first gait cycle of the user.

According to the aspect described above, the walking assistance apparatus reduces the stiffness of the wires when the leg of the user is not in contact with the ground but is in the air. High stiffness of the wires makes it difficult for the user to perform the operation of moving the leg forward. Reducing the stiffness of the wires makes it less difficult for the user to perform the operation of lifting the leg off of the ground and moving the leg forward. The walking assistance apparatus can thus more effectively assist in walking.

For example, the motors may generate tensions in the first wire and the second wire so that the stiffness of each of the first wire and the second wire is lower during a fourth period of 30% or more and 50% or less of the second gait cycle than during a third period. The third period includes (i) the period of 95% or more and 100% or less of the first gait cycle of the user and (ii) a period of 0% or more and 30% or less of the second gait cycle.

According to the aspect described above, the walking assistance apparatus can provide a smooth change in stiffness during the transition from a state in which comparatively high stiffness assists the user in keeping the leg in contact with the ground (third period) to a state in which the user holds the leg off the ground (second period). The change in force applied to the user by the walking assistance apparatus is made smooth, which advantageously facilitates walking of the user.

In a method for controlling a walking assistance apparatus according to another aspect of the present disclosure, the walking assistance apparatus includes a suit to be worn on a knee and a waist of a user, a first wire that couples a portion that is included in the suit and worn above the knee of the user to a portion that is included in the suit and worn on the waist of the user, a second wire that couples a portion that is included in the suit and worn above a back of the knee of the user to a portion that is included in the suit and worn on the waist of the user, motors coupled to the first wire and the second wire, and a control circuit. The motors and the first wire and the second wire are in a one-to-one relationship. The method includes acquiring, by the control circuit, a first gait cycle of the user and a second gait cycle subsequent to the first gait cycle, the first gait cycle and the second gait cycle being consecutive, and outputting, by the control circuit, control signals to the motors for causing the motors to generate tensions in the first wire and the second wire so that each of the first wire and the second wire has a stiffness greater than 200 N/m during a first period. The first period includes (i) a period of 95% or more and 100% or less of the first gait cycle and (ii) a period of 0% or more and 50% or less of the second gait cycle.

For example, in the method, the motors may generate the tensions by winding or unwinding the first wire and the second wire.

For example, in the method, the motors may generate tensions in the first wire and the second wire so that each of the first wire and the second wire has a stiffness less than or equal to 200 N/m during a second period of 50% or more and 95% or less of the first gait cycle of the user.

For example, the motors may generate the tensions in the first wire and the second wire so that the stiffness of each of the first wire and the second wire is lower during a fourth period of 30% or more and 50% or less of the second gait cycle than during a third period. The third period includes (i) the period of 95% or more and 100% or less of the first gait cycle of the user and (ii) a period of 0% or more and 30% or less of the second gait cycle.

Thus, advantages similar to those of the walking assistance apparatus described above are achievable.

It should be noted that general or specific aspects may be implemented as a system, a method, an integrated circuit, a computer program, a computer-readable recording medium such as a CD-ROM, or any selective combination thereof.

The following describes an embodiment in detail with reference to the drawings.

The following embodiment provides general or specific examples. Numerical values, shapes, materials, constituent elements, arrangement positions and connection forms of the constituent elements, steps, the order of the steps, and so on in the following embodiment are merely examples and are not intended to limit the present disclosure. The constituent elements mentioned in the following embodiment are described as optional constituent elements unless they are specified in independent claims that define the present disclosure in its broadest concept.

Embodiment

FIG. 1 illustrates a configuration of a walking assistance apparatus 100 according to an embodiment. The walking assistance apparatus 100 illustrated in FIG. 1 includes a suit 200, a first wire 300*a*, a first wire 300*b*, a second wire 301*a*, a second wire 301*b*, motors 400, and a controller 500. The motors 400 include multiple motors.

The first wire 300*a* and the first wire 300*b* are collectively referred to also as first wires 300. The second wire 301*a* and the second wire 301*b* are collectively referred to also as second wires 301.

Suit 200

The suit 200 includes a waist belt 201, a knee belt 202, the motors 400, and the controller 500. The knee belt 202 includes a right knee belt 202*a* and a left knee belt 202*b*. For example, the waist belt 201 has the motors 400 and the controller 500.

Figure 2A:
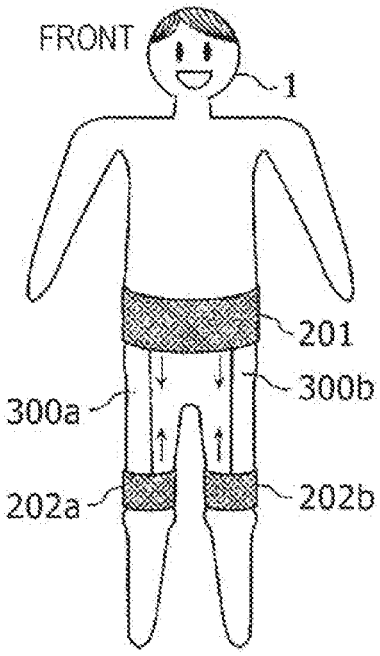
FIG. 2A is a front view of a user wearing a suit according to the embodiment, as viewed from the front of the user.

The suit 200 is worn by a user 1. FIG. 2A is a front view of the user 1 wearing the suit 200, as viewed from the front of the user 1, and FIG. 2B is a back view of the user 1 wearing the suit 200, as viewed from behind the user 1.

Figure 2B:
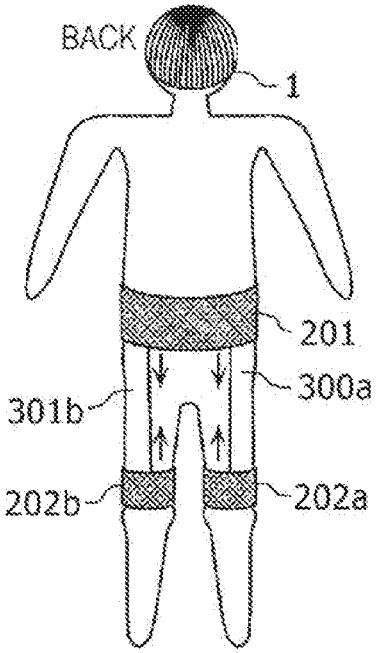
FIG. 2B is a back view of the user wearing the suit according to the embodiment, as viewed from behind the user.

As illustrated in FIG. 2A and FIG. 2B, the waist belt 201 is worn by the user 1 in such a manner as to be wrapped around the waist of the user 1. The right knee belt 202*a* and the left knee belt 202*b*, which are included in the knee belt 202, are each worn by the user 1 in such a manner as to be wrapped around a portion above the corresponding knee of the user 1. The term "portion above the knee" refers to a portion of the leg of the user 1 closer to the knee than to the waist and located on the front surface of the body of the user 1. Further, the portion above the knee is a concept including the thigh. This also applies to the following description. The waist belt 201 may be a band tied or buckled around the waist or may be a band secured by tape (a hook-and-loop fastener or a Velcro® tape). Each of the right knee belt 202*a* and the left knee belt 202*b*, which are included in the knee belt 202, may also be a band tied or buckled around a portion above the knee or may be a band secured by tape.

More typically, the waist belt 201 may be worn on a portion closer to the head than to the hip joints, such as a waist portion, a chest portion, or an abdomen portion, and the right knee belt 202*a* and the left knee belt 202*b*, which are included in the knee belt 202, may be each worn on a portion (the femoral region) closer to the corresponding knee than the hip joints.

First Wires 300 and Second Wires 301

Each of the first wires 300 couples a portion (first portion) that is included in the suit 200 and worn above the knee of the user 1 to a portion (second portion) that is included in the suit 200 and worn on the waist of the user 1. The first wires 300 are located on the front surface of the body of the user 1.

The first portions include the first portion of the right leg and the first portion of the left leg. The first wire 300*a* included in the first wires 300 is associated with the first portion of the right leg, and the first wire 300*b* included in the first wires 300 is associated with the first portion of the left leg.

The second portions include the second portion of the right waist and the second portion of the left waist. The first wire 300*a* included in the first wires 300 is associated with the second portion of the right waist, and the first wire 300*b* included in the first wires 300 is associated with the second portion of the left waist.

The first wires 300 are each arranged in such a manner as to be held under a tension greater than or equal to a predetermined value. In other words, each of the first wires 300 is arranged so as not to be bent between the corresponding first portion and the corresponding second portion.

Each of the second wires 301 couples a portion (third portion) that is included in the suit 200 and worn above the back of the knee of the user 1 to a portion (fourth portion) that is included in the suit 200 and worn on the waist of the user 1. The second wires 301 are located on the back surface of the body of the user 1.

The third portions include the third portion of the right leg and the third portion of the left leg. The second wire 301*a* included in the second wires 301 is associated with the third portion of the right leg, and the second wire 301*b* included in the second wires 301 is associated with the third portion of the left leg.

The fourth portions include the fourth portion of the right waist and the fourth portion of the left waist. The second wire 301*a* included in the second wires 301 is associated with the fourth portion of the right waist, and the second wire 301*b* included in the second wires 301 is associated with the fourth portion of the left waist.

The term "back of the knee" refers to a portion of the leg of the user 1 between the knee joint and the hip joint and located on the back surface of the body of the user 1. The "portion above the back of the knee" can be a portion opposing the "portion above the knee". The third portions are, in other words, portions of the femoral regions that are located on the back surface of the body of the user 1. Like the second portions, the fourth portions are, in other words, portions of the waist of the user 1 that are located on the back surface (referred to also as the lumbodorsal region) of the body of the user 1.

Like the first wires 300, the second wires 301 are each arranged in such a manner as to be held under a tension greater than or equal to a predetermined value. In other words, each of the second wires 301 is arranged so as not to be bent between the corresponding third portion and the corresponding fourth portion.

In the example illustrated in FIG. 2A and FIG. 2B, the first wire 300*a* is located on the front side (front surface side) of the right leg of the user 1, and the second wire 301*a* is located on the back side (back surface side) of the right leg of the user 1. The first wire 300*b* is located on the front side of the left leg of the user 1, and the second wire 301*b* is located on the back side of the left leg of the user 1.

The first wire 300*a*, the first wire 300*b*, the second wire 301*a*, and the second wire 301*b* have ends fixed to wire fixing units 210*a*, 210*b*, 210*c*, and 210*d*, respectively. The ends of the first wire 300*a*, the first wire 300*b*, the second wire 301*a*, and the second wire 301*b*, which are respectively fixed to the wire fixing units 210*a*, 210*b*, 210*c*, and 210*d*, are represented also as a first end of the first wire 300*a*, a first end of the first wire 300*b*, a first end of the second wire 301*a*, and a first end of the second wire 301*b*, respectively.

The wire fixing unit 210*a* and the wire fixing unit 210*c* are located on the right knee belt 202*a*, and the wire fixing units 210*b* and 210*d* are located on the left knee belt 202*b*. The portions worn above the knees of the user 1 are associated with the wire fixing units 210*a* and 210*b*, and the portions worn above the backs of the knees of the user 1 are associated with the wire fixing units 210*c* and 210*d*.

The first wire 300*a*, the first wire 300*b*, the second wire 301*a*, and the second wire 301*b* each have another end coupled to a corresponding one of the motors 400. The ends of the first wire 300*a*, the first wire 300*b*, the second wire 301*a*, and the second wire 301*b*, which are coupled to the motors 400, are represented also as a second end of the first wire 300*a*, a second end of the first wire 300*b*, a second end of the second wire 301*a*, and a second end of the second wire 301*b*, respectively.

Figure 3:
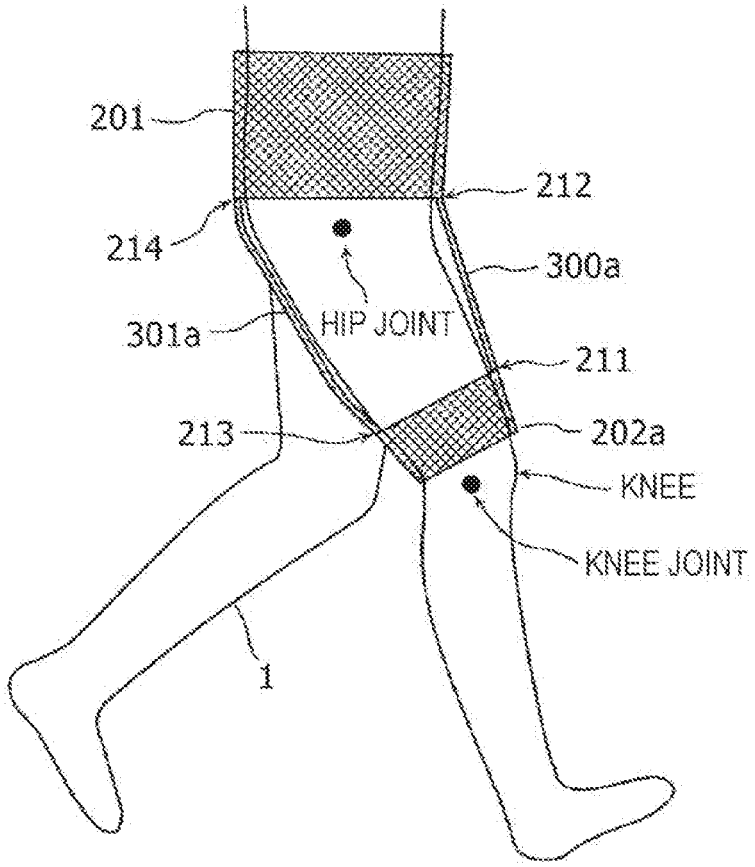
FIG. 3 is a side view of the user wearing the suit according to the embodiment, as viewed from a side of the user.

The following describes in more detail the portions that are included in the suit 200 and worn above the knees of the user 1 and the portions that are included in the suit 200 and worn on the waist of the user 1. FIG. 3 is a side view of the user 1 wearing the suit 200, as viewed from a side thereof. Focusing on the right leg of the user 1, the following describes the right knee belt 202*a* to be worn on the right leg of the user 1.

In FIG. 3, a first portion 211 of the right knee belt 202*a* is a portion worn above the knee of the right leg (the first portion of the right leg) among the portions worn above the knees of the user 1, and a second portion 212 of the waist belt 201 is a portion worn on the right waist (the second portion of the right waist) among the portions worn on the waist of the user 1.

The portion worn above the knee of the right leg may be located at any position between the knee joint and the hip joint of the right leg, that is, within a portion of the femoral region of the right leg that is located on the front surface of the body of the user 1. The portion worn on the right waist may be located at any position near the right half of the pelvis, that is, within a portion ranging from the hip joint to the right waist and located on the front surface of the body of the user 1.

In FIG. 3, a third portion 213 of the right knee belt 202*a* is a portion worn above the back of the knee of the right leg (the third portion of the right leg) among the portions worn above the backs of the knees of the user 1, and a fourth portion 214 of the waist belt 201 is a portion worn on the right waist (the fourth portion of the right waist) among the portions worn on the waist of the user 1.

Thus, the hip joint of the user 1 is located between the second portion 212 (the portion of the waist belt 201 that is coupled to the first wire 300*a*) and the first portion 211 (the portion of the right knee belt 202*a* that is coupled to the first wire 300*a*). Further, the hip joint of the user 1 is located between the fourth portion 214 (the portion of the waist belt 201 that is coupled to the second wire 301*a*) and the third portion 213 (the portion of the right knee belt 202*a* that is coupled to the second wire 301*a*). As a result, torque and stiffness generated by the tension of the first wire 300*a* and the second wire 301*a* can assist in hip joint movement of the user 1 during walking.

In other words, with the arrangement described above, the hip joint of the user 1 is located between the second portion 212 and the first portion 211, but no other joint of the user 1 is located between the second portion 212 and the first portion 211. Likewise, the hip joint of the user 1 is located between the fourth portion 214 and the third portion 213, but no other joint of the user 1 is located between the fourth portion 214 and the third portion 213. Thus, the torque generated by the tension of the first wire 300*a* and the second wire 301*a* can be more directly applied to the hip joint of the user 1 and can assist the user 1 in walking. In addition, the stiffness generated by the tension of the first wire 300*a* and the second wire 301*a* can be more directly applied to the hip joint of the user 1 and can assist the user 1 in walking.

The third portion 213 of the right knee belt 202*a* is a portion that is included in the suit 200 and worn above the back of the knee of the user 1, and the fourth portion 214 of the waist belt 201 is a portion that is included in the suit 200 and worn on the waist of the user 1.

It is desirable that the first wire 300*a* be fixed to at least the first portion 211 and the second portion 212. It is also desirable that the second wire 301*a* be fixed to at least the third portion 213 and the fourth portion 214.

The foregoing has described the right leg of the user 1, by way of example. The left knee belt 202*b* to be worn on the left leg of the user 1 and the first wire 300*b* and the second wire 301*b* to be attached to the left leg of the user 1 can be described in a way similar to that described above.

Motors 400

Each of the motors 400 has a shaft or a pulley coupled to a shaft. The first wire 300*a*, the first wire 300*b*, the second wire 301*a*, and the second wire 301*b* are each coupled to the shaft or pulley of the corresponding one of the motors 400. As an example, the motors 400 are electromagnetic motors that perform position control. Each of the motors 400 acquires a control signal from the controller 500 and operates in accordance with the control signal.

When the first wire 300*a*, the first wire 300*b*, the second wire 301*a*, and the second wire 301*b* are each wound by the corresponding one of the motors 400, the lengths of the first wire 300*a*, the first wire 300*b*, the second wire 301*a*, and the second wire 301*b* appear to be shorter accordingly. As a result, the tension of the first wire 300*a*, the first wire 300*b*, the second wire 301*a*, and the second wire 301*b* is enhanced. The length of the first wire 300*a* indicates the distance between the corresponding one of the motors 400 and the portion of the right knee belt 202*a* that is coupled to the first wire 300*a*. In other words, the length of the first wire 300*a* is a length obtained by subtracting the length of a portion of the first wire 300*a* that is wound around the pulley of the corresponding one of the motors 400 from the total length of the first wire 300*a*. The same applies to the first wire 300*b*.

The length of the second wire 301*a* is a length obtained by subtracting the length of a portion of the second wire 301*a* that is wound around the pulley of the corresponding one of the motors 400 from the total length of the second wire 301*a*. The same applies to the second wire 301*b*.

The following describes the tension of the first wire 300*a* and the tension of the second wire 301*a* with reference to FIG. 3.

In FIG. 3, the distance between the first portion 211 and the second portion 212 and the distance between the third portion 213 and the fourth portion 214 are each determined to be a minimum distance in accordance with the shape and dimensions of the corresponding part of the body of the user 1. When the distance between the first portion 211 and the second portion 212 is equal to the minimum distance, the corresponding one of the motors 400 operates so as to increase the motor torque in a direction in which the first wire 300*a* is wound, thereby enhancing the tension of the first wire 300*a* with the length of the first wire 300*a* being kept unchanged. Likewise, when the distance between the third portion 213 and the fourth portion 214 is equal to the minimum distance, the corresponding one of the motors 400 operates so as to increase the motor torque in a direction in which the second wire 301*a* is wound, thereby enhancing the tension of the second wire 301*a* with the length of the second wire 301*a* being kept unchanged.

That is, the tension of the first wire 300*a* is enhanced by causing the corresponding one of the motors 400 to operate so as to increase the motor torque in the direction in which the first wire 300*a* is wound while keeping the first wire 300*a* in the unbent state between the first portion 211 and the second portion 212. The tension of the second wire 301*a* is enhanced by causing the corresponding one of the motors 400 to operate so as to increase the motor torque in the direction in which the second wire 301*a* is wound while keeping the second wire 301*a* in the unbent state between the third portion 213 and the fourth portion 214.

Further, when the first wire 300*a*, the first wire 300*b*, the second wire 301*a*, and the second wire 301*b* are each unwound by the corresponding one of the motors 400, the lengths of the first wires 300*a* and 300*b* and the second wires 301*a* and 301*b* appear to be longer accordingly. As a result, the tension of the first wire 300*a*, the first wire 300*b*, the second wire 301*a*, and the second wire 301*b* is reduced. The length of the first wire 300*a* is a length obtained by subtracting the length of a portion of the first wire 300*a* that is wound around the pulley of the corresponding one of the motors 400 from the total length of the first wire 300*a*. The same applies to the first wire 300*b*. The length of the second wire 301*a* is a length obtained by subtracting the length of a portion of the second wire 301*a* that is wound around the pulley of the corresponding one of the motors 400 from the total length of the second wire 301*a*. The same applies to the second wire 301*b*.

When the distance between the first portion 211 and the second portion 212 is equal to the minimum distance, the corresponding one of the motors 400 operates so as to decrease the motor torque in the direction in which the first wire 300*a* is wound, thereby reducing the tension of the first wire 300*a* with the length of the first wire 300*a* being kept unchanged. Likewise, when the distance between the third portion 213 and the fourth portion 214 is equal to the minimum distance, the corresponding one of the motors 400 operates so as to decrease the motor torque in the direction in which the second wire 301*a* is wound, thereby reducing the tension of the second wire 301*a* with the length of the second wire 301*a* being kept unchanged.

That is, the tension of the first wire 300*a* is reduced by causing the corresponding one of the motors 400 to operate so as to decrease the motor torque in the direction in which the first wire 300*a* is wound while keeping the first wire 300*a* in the unbent state between the first portion 211 and the second portion 212. The tension of the second wire 301*a* is reduced by causing the corresponding one of the motors 400 to operate so as to decrease the motor torque in the direction in which the second wire 301*a* is wound while keeping the second wire 301*a* in the unbent state between the third portion 213 and the fourth portion 214.

The foregoing has described the tension of the first wire 300*a* and the tension of the second wire 301*a* with reference to FIG. 3. Although not described herein, the tension of the first wire 300*b* and the tension of the second wire 301*b* can be described in a way similar to that described above, i.e., "the description of the tension of the first wire 300*a* and the tension of the second wire 301*a* with reference to FIG. 3".

Controller 500

The controller 500 is a control device for controlling the motors 400. The controller 500 includes a control circuit 501, an input/output interface (IF) 502, and a power supply 503. More specifically, the controller 500 controls the motors 400 to wind the first wire 300*a*, the second wire 301*a*, the first wire 300*b*, and the second wire 301*b* and controls the motors 400 to unwind the first wire 300*a*, the second wire 301*a*, the first wire 300*b*, and the second wire 301*b*.

For example, the controller 500 controls the operation of the motors 400 in accordance with information including information about the amounts of winding of the first wire 300*a*, the second wire 301*a*, the first wire 300*b*, and the second wire 301*b*, information about the amounts of unwinding of the first wire 300*a*, the second wire 301*a*, the first wire 300*b*, and the second wire 301*b*, information about the timings of winding of the first wire 300*a*, the second wire 301*a*, the first wire 300*b*, and the second wire 301*b*, and information about the timings of unwinding of the first wire 300*a*, the second wire 301*a*, the first wire 300*b*, and the second wire 301*b*.

As an example, the controller 500 includes the control circuit 501, which is implemented as a typical microcontroller, the input/output IF 502, and the power supply 503.

The input/output IF 502 is an interface board coupled to an expansion slot of the microcontroller, such as a Peripheral Component Interconnect (PCI) bus. Examples of the interface board include a digital-to-analog (D/A) board, an analog-to-digital (A/D) board, and a counter board.

The control circuit 501 sends a control signal to the motors 400 via the input/output IF 502. The input/output IF 502 accepts information on the positions of the motors 400, information on the torques of the motors 400, and signals from external sensors.

Figure 4:
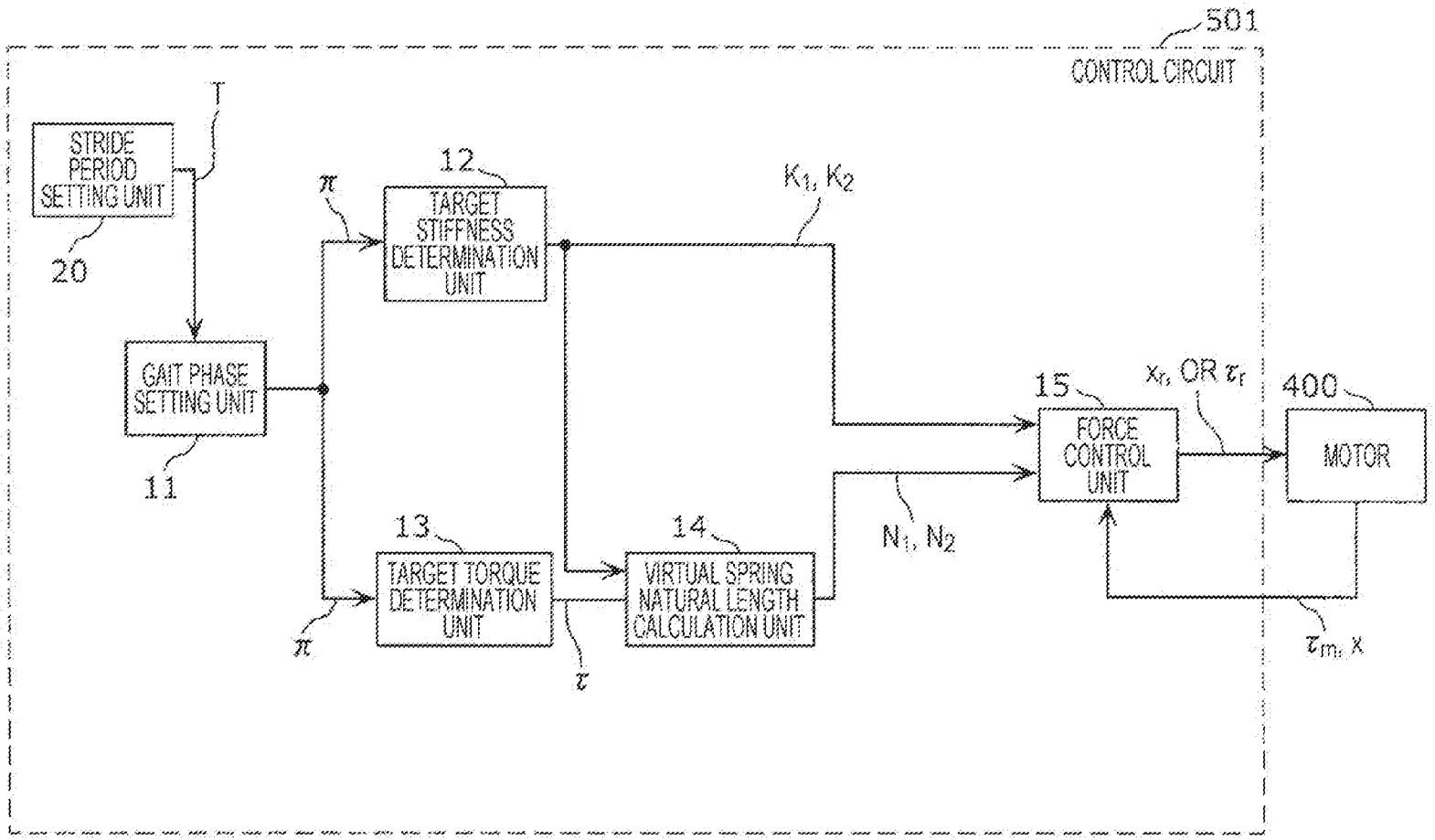
FIG. 4 is a functional block diagram of a motor controller according to the embodiment.

FIG. 4 is a functional block diagram of the control circuit 501. The control circuit 501 includes a stride period setting unit 20, a gait phase setting unit 11, a target stiffness determination unit 12, a target torque determination unit 13, a virtual spring natural length calculation unit 14, and a force control unit 15. The details will be described below.

The control circuit 501 acquires information about the gait cycle of the right leg and information about the gait cycle of the left leg and outputs a control signal to the motors 400 in accordance with the acquired information about the gait cycle of the right leg and the acquired information about the gait cycle of the left leg.

The control signal is a signal for generating a tension so that each of the first wire 300*a* and the second wire 301*a* has a stiffness greater than or equal to a predetermined value during a first period of the right leg within the gait cycle of the right leg, and for generating a tension so that each of the first wire 300*a* and the second wire 301*a* has a stiffness greater than or equal to the predetermined value during a first period of the left leg within the gait cycle of the left leg.

The following describes walking assistance for the right leg. The first period of the right leg includes a period of 95% or more and 100% or less of a first gait cycle of the right leg (=the n-th step of the right leg (where n is a natural number)), and a period of 0% or more and 50% or less of a second gait cycle of the right leg (=the (n+1)-th step of the right leg), which is subsequent to the first gait cycle of the right leg. The first gait cycle of the right leg and the second gait cycle of the right leg are consecutive gait cycles of the right leg. That is, the time of 100% of the first gait cycle of the right leg and the time of 0% of the second gait cycle of the right leg are the same. The predetermined value is 200 N/m, for example. The value "200 N/m" is derived by the walking assistance apparatus 100 as a minimum value necessary for appropriately assisting in walking.

The control signal may include a signal for generating a tension so that each of the first wire 300*a* and the second wire 301*a* has a stiffness less than or equal to the predetermined value during a period (corresponding to a second period) of 50% or more and 95% or less of the first gait cycle of the right leg (the n-th step of the right leg).

Note that the control signal may include a signal for generating a tension so that the stiffness of the first wire 300*a* and the second wire 301*a* is lower during a period (corresponding to a fourth period) of 30% or more and 50% or less of the second gait cycle of the right leg (=the (n+1)-th step of the right leg) than during a continuous period (corresponding to a third period) including a period of 95% or more and 100% or less of the first gait cycle of the right leg (=the n-th step of the right leg) and a period of 0% or more and 30% or less of the second gait cycle of the right leg (=the (n+1)-th step of the right leg), which is subsequent to the first gait cycle of the right leg.

The foregoing has described the walking assistance for the right leg. The walking assistance for the left leg can also be described in a similar way.

The stride period setting unit 20 acquires gait information of the user 1, which is measured by sensors or an external device. The gait information is information indicating features of walking of the user 1. For example, the gait information includes information indicating the timing at which the foot of the user 1 makes contact with the ground during walking, or information indicating a change in the angle of the foot.

The stride period setting unit 20 sets a stride period T by using the acquired gait information of the user 1 and outputs the stride period T to the gait phase setting unit 11. The stride period T indicates a time interval from when the right leg of the user 1 makes contact with the ground to when the right leg again makes contact with the ground or a time interval from when the left leg of the user 1 makes contact with the ground to when the left leg again makes contact with the ground.

Figure 5:
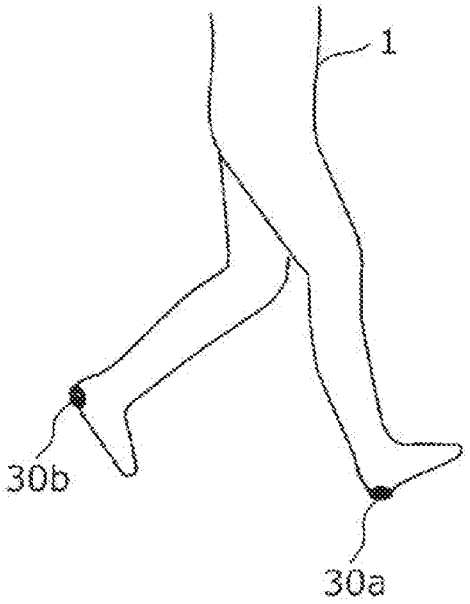
FIG. 5 illustrates the arrangement of pressure sensors according to the embodiment.

FIG. 5 illustrates pressure sensors 30*a* and 30*b* (hereinafter collectively referred to also as pressure sensors 30), which are an example of the sensors. The pressure sensors 30 are attached to portions near the heels of a person. Signals acquired from the pressure sensors 30 can be used to determine whether the heels are in contact with the ground. The signals from the pressure sensors 30 represent measured pressure values. For example, in a period during which the pressure sensors 30 measure pressure values greater than or equal to a predetermined value, the heels are in contact with the ground.

The signals from the pressure sensors 30 are input to the control circuit 501 via the input/output IF 502.

Figure 6:
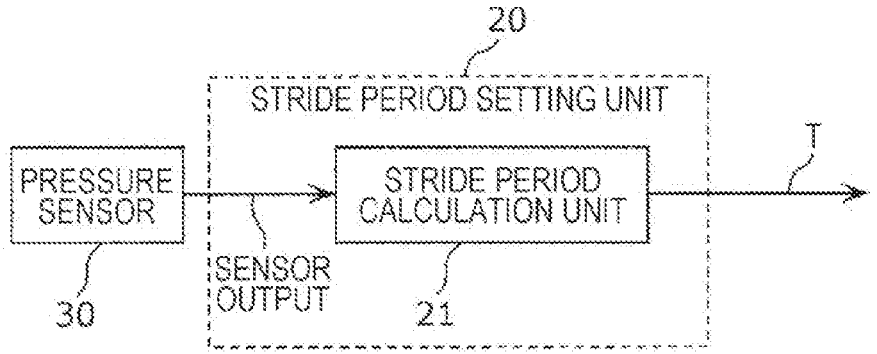
FIG. 6 is a block diagram illustrating an example of the pressure sensors and a stride period setting unit according to the embodiment.

FIG. 6 illustrates an example of the stride period setting unit 20. The stride period setting unit 20 outputs the stride period T in accordance with the signals acquired from the pressure sensors 30. The stride period setting unit 20 includes a stride period calculation unit 21.

For example, the stride period calculation unit 21 determines a first timing at which an increase in pressure value by an amount greater than or equal to a predetermined level is detected in the signal acquired from the pressure sensor 30*a* and records the first timing in a memory as gait information. The stride period calculation unit 21 determines a second timing at which an increase in pressure value by an amount greater than or equal to the predetermined level is subsequently detected in the signal acquired from the pressure sensor 30*a* and records the second timing in the memory as gait information. Note that the stride period calculation unit 21 does not detect an increase in pressure value by an amount greater than or equal to the predetermined level in the signal acquired from the pressure sensor 30*a* during the period between the first timing and the second timing. For example, in the acquisition of a timing at which the heel of the right leg of the user 1 makes contact with the ground, an increase in pressure value by an amount greater than or equal to the predetermined level is a change of the pressure value from approximately 0 to a pressure value greater than or equal to the predetermined level. The stride period calculation unit 21 outputs the time interval from the first timing to the second timing as the stride period T. In the foregoing description, a time interval obtained from timings determined using the signal acquired from the pressure sensor 30*a* is output as the stride period T. Alternatively, the stride period T may be determined by using a signal acquired from the pressure sensor 30*b*. That is, the stride period calculation unit 21 determines a third timing at which an increase in pressure value by an amount greater than or equal to a predetermined level is detected in the signal acquired from the pressure sensor 30*b* and records the third timing in the memory as gait information. The stride period calculation unit 21 determines a fourth timing at which an increase in pressure value by an amount greater than or equal to the predetermined level is subsequently detected in the signal acquired from the pressure sensor 30*b* and records the fourth timing in the memory as gait information. Note that the stride period calculation unit 21 does not detect an increase in pressure value by an amount greater than or equal to the predetermined level in the signal acquired from the pressure sensor 30*b* during the period between the third timing and the fourth timing. For example, in the acquisition of a timing at which the heel of the left leg of the user 1 makes contact with the ground, an increase in pressure value by an amount greater than or equal to the predetermined level is a change of the pressure value from approximately 0 to a pressure value greater than or equal to the predetermined level. The stride period calculation unit 21 outputs the time interval from the third timing to the fourth timing as the stride period T.

For example, when the stride period calculation unit 21 outputs a stride period T at the timing when the heel of the right leg of the user 1 makes contact with the ground, the stride period T is updated at the timing when the heel of the right leg of the user 1 makes contact with the ground. For example, when the stride period calculation unit 21 outputs a stride period T at the timing when the heel of the left leg of the user 1 makes contact with the ground, the stride period T is updated at the timing when the heel of the left leg of the user 1 makes contact with the ground.

The sensors in the example illustrated in FIG. 6 are the pressure sensors 30. Alternatively, for example, angle sensors may be used. When angle sensors are used as sensors, the angle sensors are attached to the femoral regions of the user 1, as an example. The controller 500 acquires the angles of the hip joints of the user 1. The stride period setting unit 20 determines a stride period T in accordance with the angles of the hip joints of the user 1.

The gait phase setting unit 11 estimates the current phase of the gait cycle $\pi$ from the stride period T. In the following description, each phase of the gait cycle $\pi$ may be referred to simply as gait phase $\pi$. Each gait phase $\pi$ is a value which is a measure of the rate of progress at the current time point expressed in percentages (%), with 1 representing the stride period T.

Figure 7:
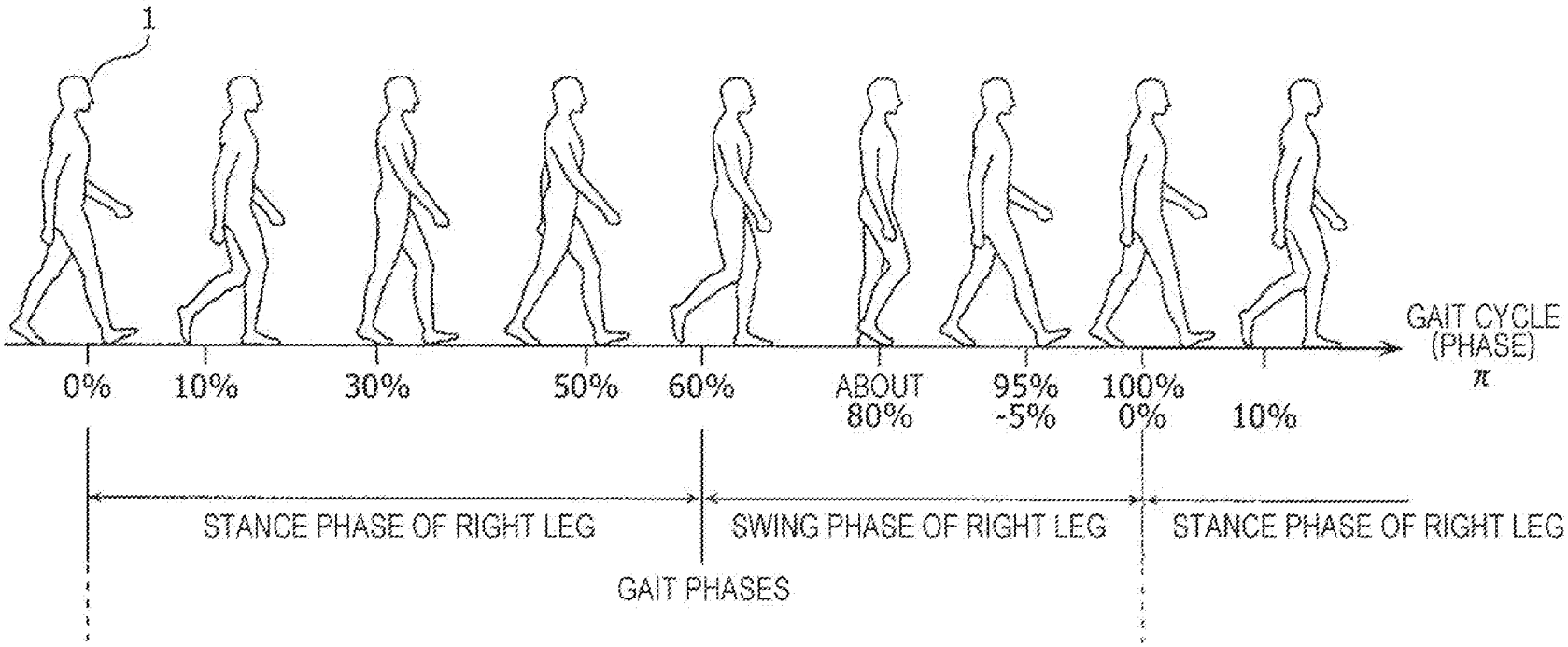
FIG. 7 illustrates an example of a change in gait phase within a gait cycle.

FIG. 7 illustrates an example of a change in the percentage of gait phases of a gait cycle. In FIG. 7, each gait phase focusing on the right leg of the user 1 is expressed in %. The following describes walking assistance for the right leg.

At the time point of 0% of a gait cycle of the right leg illustrated in FIG. 7, the right foot of the user 1 makes contact with the ground. In FIG. 7, the period of 0% or more and 60% or less of the gait cycle of the right leg is represented also as a stance phase, and the period of 60% or more and 100% or less of the gait cycle of the right leg is represented also as a swing phase.

The gait phase setting unit 11 illustrated in FIG. 4 acquires the stride period T of the right leg from the stride period setting unit 20. The gait phase setting unit 11 stores in a memory multiple stride periods within a predetermined period up to the current time point and calculates the current stride period $T_{new}$ of the right leg by using the average value of the multiple stride periods of the right leg within the predetermined period up to the current time point.

For example, the gait phase setting unit 11 stores in the memory stride periods T of the right leg, the number of which is determined in advance using an experiment or the like. For example, stride periods for three cycles are used. In this case, the gait phase setting unit 11 stores the most recent two stride periods T of the right leg in the memory. At the timing when a new stride period T of the right leg is input, the gait phase setting unit 11 calculates the average value of the previous two stride periods T of the right leg and the current input stride period T, that is, three stride periods T in total, and determines a stride period $T_{new}$.

Since the timing at which the stride period T of the right leg is updated is equal to the timing of 0% of a gait cycle, the percentage of a gait phase of the right leg (=the gait phase $\pi$ of the right leg) can be calculated using equation (1) below when the current time is denoted by t and the time at which a new stride period T of the right leg is input is denoted by $t_0$. The timing at which the stride period T of the right leg is updated may be considered as the second timing at which the stride period calculation unit 21 detects an increase in pressure value by an amount greater than or equal to the predetermined level in the signal acquired from the pressure sensor 30*a*. This is because the time period during which the stride period calculation unit 21 outputs the time interval from the first timing to the second timing as a stride period T of the right leg is shorter than the stride period T.

$$\pi = \min\left\{\frac{t - t_0}{T_{new}}, 1\right\} \tag{1}$$

Equation (1) is calculated such that 1 is not exceeded when the current stride period is longer than the average stride period. Other applications are possible such that 0.6 is not exceeded when the leg is determined to be in the stance phase from the signal value from the corresponding one of the pressure sensors 30 (=when a pressure value greater than or equal to a predetermined value is obtained from the corresponding one of the pressure sensors 30).

The gait phase setting unit 11 outputs the percentage of the gait phase of the right leg to the target stiffness determination unit 12 and the target torque determination unit 13.

The target stiffness determination unit 12 outputs target wire stiffness values $K_1$ and $K_2$ corresponding to the percentage of the gait phase of the right leg in accordance with pre-stored rules. An example of the rules is a table including target wire stiffness values $K_1$, and $K_2$ for the percentage of each gait phase. The target wire stiffness value $K_1$ is a stiffness value of the first wire 300*a*, and the target wire stiffness value $K_2$ is a stiffness value of the second wire 301*a*.

The target stiffness determination unit 12 outputs a target wire stiffness value greater than or equal to a predetermined value at the time point of 95% of the gait cycle of the right leg. This indicates that a tension simulated using a high-stiffness virtual spring (described below) is generated in a wire immediately before the stance phase is reached.

The target stiffness determination unit 12 further outputs a target wire stiffness value less than or equal to the predetermined value during the period of 50% or more and 95% or less of the gait cycle of the right leg.

The target torque determination unit 13 determines the value of torque to be generated around the hip joint by the first wire 300*a* and the second wire 301*a* in accordance with the value of the percentage of the gait phase of the right leg. For example, the target torque determination unit 13 determines the value of torque in accordance with a target joint torque T with reference to the pre-stored rules.

Figures 13, 14:
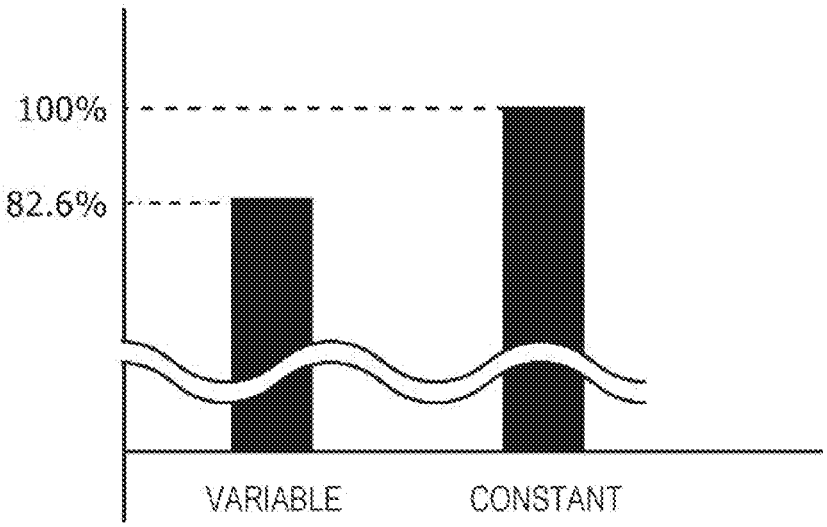
FIG. 13 illustrates results of a metabolic rate of a person in terms of energy in the experiment in which the second wires are attached.
FIG. 14 illustrates an example of target joint torques stored in a target torque determination unit.

FIG. 14 illustrates an example of the rules. FIG. 14 is a diagram illustrating an example of target joint torques stored in the target torque determination unit 13. The rules are represented as a table including a torque value for the percentage of each gait phase. The target torque determination unit 13 can determine a target torque for the percentage of each gait phase by performing linear interpolation or other processing for the percentage of the gait phase in accordance with the values illustrated in FIG. 14.

The walking assistance apparatus 100 generates a torque in the same direction as the acceleration of the leg of the user 1. Thus, the walking assistance apparatus 100 can assist in applying a torque to the right leg of the user 1 while the user 1 is walking. As a result, the walking assistance apparatus 100 can appropriately assist the user 1 in walking.

The virtual spring natural length calculation unit 14 calculates natural lengths of virtual springs simulated by wires, more specifically, wire virtual-spring natural lengths $N_1$ and $N_2$, in accordance with the target joint torque value t and the target wire stiffness values $K_1$ and $K_2$.

The virtual spring indicates a pseudo-spring used to determine the tension of the first wire 300*a* and the tension of the second wire 301*a*. Each of the first wire 300*a* and the second wire 301*a* is wound or unwound by the corresponding one of the motors 400, thereby having a tension that is simulated using a virtual spring having a predetermined stiffness (or recovery force).

The torque to be generated around the hip joint of the user 1 by the first wire 300*a* and the second wire 301*a* is determined in accordance with the difference between the torque applied to the hip joint by the first wire 300*a* and the torque applied to the hip joint by the second wire 301*a*.

The torque generated by the first wire 300*a* and the second wire 301*a* is in proportion to the target stiffness value $K_1$ of the first wire 300*a*, the target stiffness value $K_2$ of the second wire 301*a*, the amount of change in the length of the virtual spring of the first wire 300*a*, and the amount of change in the length of the virtual spring of the second wire 301*a*. The amount of change in the length of the virtual spring of the first wire 300*a* and the amount of change in the length of the virtual spring of the second wire 301*a* are determined from the torque generated by the first wire 300*a* and the second wire 301*a*, the target stiffness value $K_1$ of the first wire 300*a*, and the target stiffness value $K_2$ of the second wire 301*a*. The virtual spring natural length calculation unit 14 determines in advance each of the wire virtual-spring natural lengths $N_1$ and $N_2$ on the basis of a value corresponding to a virtual-spring attachment length by subtracting the amount of change in virtual spring from the virtual-spring attachment length.

The force control unit 15 performs force control calculation by using the target wire stiffness values $K_1$ and $K_2$, the wire virtual-spring natural lengths $N_1$ and $N_2$, and motor torques $\tau_m$ respectively acquired from the motor corresponding to the first wire 300*a* and the motor corresponding to the second wire 301*a* among the motors 400 so that each of the first wire 300*a* and the second wire 301*a* has a tension simulated using a virtual spring. Then, the force control unit 15 outputs a target motor position $x_r=[x_{r1}, x_{r2}]$ to each of the motor corresponding to the first wire 300*a* and the motor corresponding to the second wire 301*a* among the motors 400.

An example of the force control calculation is as follows. In the following description, the first wire 300*a* and the second wire 301*a* may also be referred to simply as wires.

When a motor torque is represented as $\tau_m=[\tau_{m1}, \tau_{m2}]$ and the tension of the corresponding wire at this time is represented as $F_m=[F_{m1}, F_{m2}]$, the tension of the wire can be determined using the following equation.

$$F=G\tau \tag{2}$$

In equation (2), G is a conversion coefficient determined from the gear ratio and the radius of the pulley. At this time, the target motor position is determined in the following way.

$$x_m = \frac{1}{G}\left(\frac{F}{k_n} - N_n\right), \text{ where } n = 1, 2 \quad (3)$$

In this way, the force control unit 15 determines the respective target positions $x_r=[x_{r1}, x_{r2}]$ of the motor corresponding to the first wire 300*a* and the motor corresponding to the second wire 301*a* among the motors 400 and outputs the determined target positions $x_r$ to the motor corresponding to the first wire 300*a* and the motor corresponding to the second wire 301*a* among the motors 400 via the input/output IF 502.

Each of the motor corresponding to the first wire 300*a* and the motor corresponding to the second wire 301*a* among the motors 400 moves to the input target motor position $x_r$. Thus, the first wire 300*a* coupled to the motor corresponding to the first wire 300*a* among the motors 400 and the second wire 301*a* coupled to the motor corresponding to the second wire 301*a* among the motors 400 each have a tension simulated using a virtual spring. That is, the first wire 300*a* and the second wire 301*a* generate tensions equivalent to tensions that would be generated by virtual springs having the target wire stiffness values $K_1$ and $K_2$, respectively.

The foregoing describes an example in which the motor corresponding to the first wire 300*a* and the motor corresponding to the second wire 301*a* among the motors 400 operate under position control. The motor corresponding to the first wire 300*a* and the motor corresponding to the second wire 301*a* among the motors 400, which operate under torque control, can also be implemented in a similar manner.

When the motor corresponding to the first wire 300*a* and the motor corresponding to the second wire 301*a* among the motors 400 operate under torque control, the force control unit 15 performs force control calculation by using the target wire stiffness values $K_1$ and $K_2$ output from the target stiffness determination unit 12, the wire virtual-spring natural lengths $N_1$ and $N_2$, and motor position information $x_m$, which is acquired from each of the motor corresponding to the first wire 300*a* and the motor corresponding to the second wire 301*a* among the motors 400, so that each of the first wire 300*a* and the second wire 301*a* has a tension simulated using a virtual spring. As a result, the force control unit 15 determines the respective motor target torques $\tau_m=[\tau_{m1}, \tau_{m2}]$ of the motor corresponding to the first wire 300*a* and the motor corresponding to the second wire 301*a* among the motors 400 and outputs the motor target torques $\tau_m$ to the corresponding motors 400.

The motor corresponding to the first wire 300*a* and the motor corresponding to the second wire 301*a* among the motors 400 operate so as to generate the corresponding motor target torques $\tau_m=[\tau_{m1}, \tau_{m2}]$, thereby allowing one of the first wires 300 coupled to the motor corresponding to the first wire 300*a* among the motors 400 and one of the second wires 301 coupled to the motor corresponding to the second wire 301*a* among the motors 400 to have tensions simulated using the respective virtual springs. That is, the first wire 300*a* and the second wire 301*a* can generate tensions equivalent to tensions that would be generated by springs having the target wire stiffness values $K_1$ and $K_2$, respectively.

The foregoing has described the walking assistance for the right leg with reference to FIG. 7 and other figures. The walking assistance for the left leg can also be described in a similar way. The rules illustrated in FIG. 14 may be used in common or separately to control the walking assistance for the right leg and to control the walking assistance for the left leg.

Experimental Results

Figure 8A:
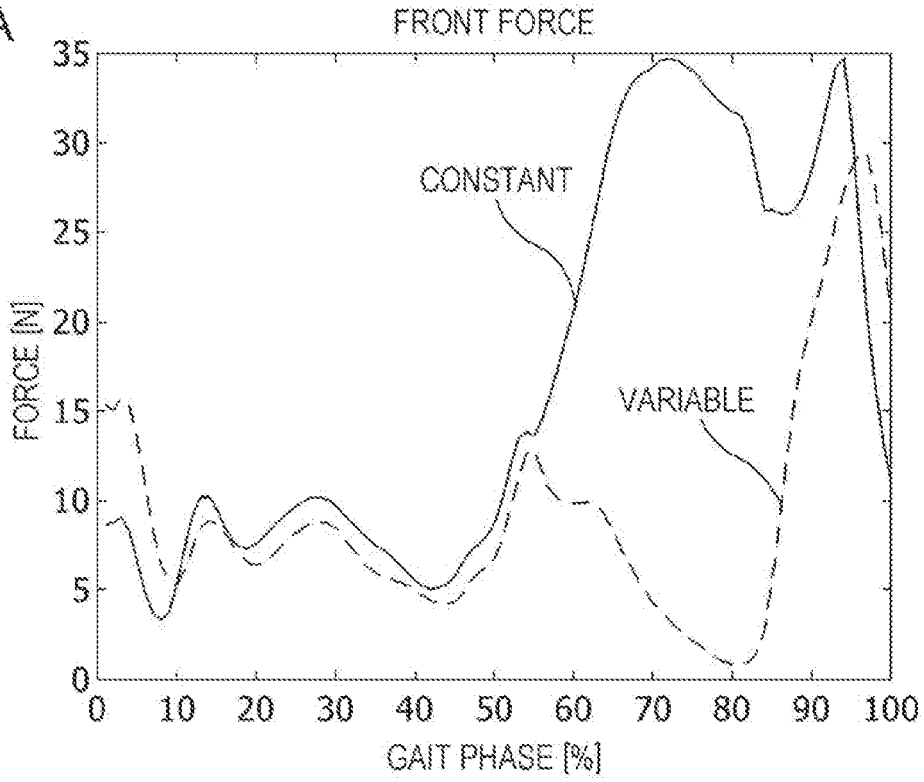
FIG. 8A illustrates wire tension results in an experiment in which second wires are attached.
Figure 8B:
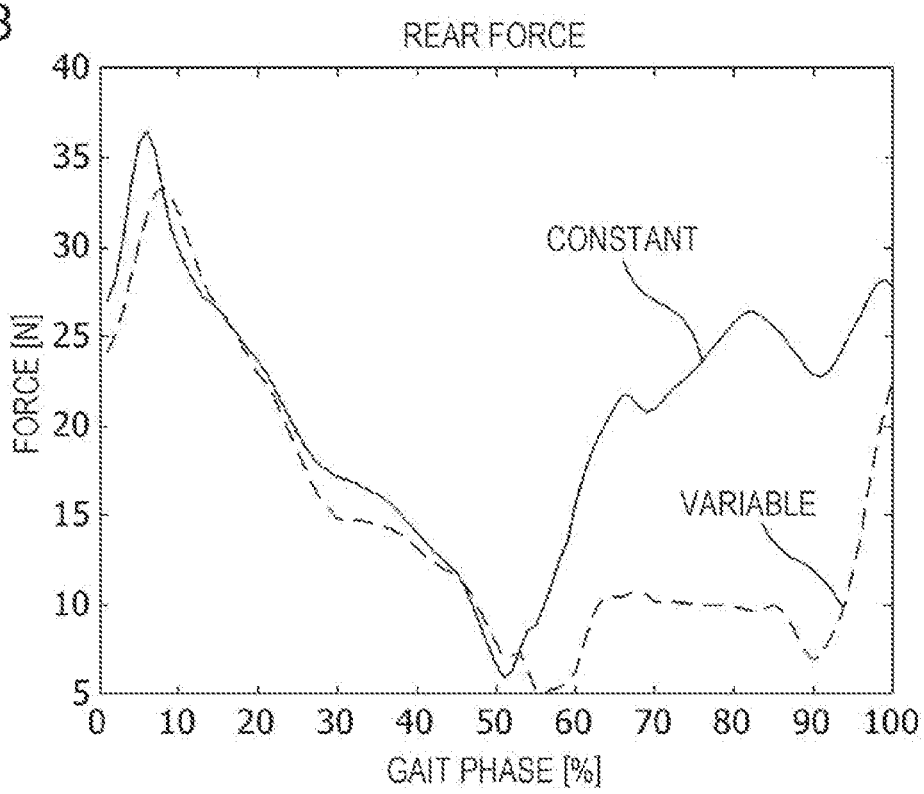
FIG. 8B illustrates wire tension results in the experiment in which the second wires are attached.

FIG. 8A, FIG. 8B, and FIG. 13 illustrate experimental results obtained by the inventors.

The user 1 wearing a suit walked at 4.5 km per hour. The suit includes a first wire 300 and a second wire 301. The first wire 300 was located on the front surface of the body of the user 1, and the second wire 301 was located on the back surface of the body of the user 1. The first wire 300 coupled a portion that was included in the suit and worn above a knee of the user 1 to a portion that was included in the suit and worn on the waist of the user 1. Motors 400, each of which was coupled to one of the first wire 300 and the second wire 301, were controlled by the force control unit 15 to operate so that each of the first wire 300 and the second wire 301 had a tension equivalent to that of a virtual spring.

FIG. 8A illustrates experimental results indicating the tension of the first wire 300 for the percentage of each gait phase. FIG. 8B illustrates experimental results indicating the tension of the second wire 301 for the percentage of each gait phase. In FIG. 8A and FIG. 8B, the vertical axis represents tension (N) and the horizontal axis represents the percentage of gait phases (%).

In FIG. 8A, the solid line indicates a result obtained when motor control was performed so that the first wire 300 had a tension simulated using a high-stiffness spring having a stiffness higher than 200 N/m (e.g., 1000 N/m), regardless of the percentage of gait phases (hereinafter represented as "Constant").

In FIG. 8B, likewise, the solid line indicates a result obtained when motor control was performed so that the second wire 301 had a tension simulated using a high-stiffness spring having a stiffness higher than 200 N/m (e.g., 1000 N/m), regardless of the percentage of gait phases (hereinafter represented as "Constant").

In FIG. 8A, the dashed line indicates a result obtained when motor control was performed so that the first wire 300 operated to simulate a spring having a stiffness of 200 N/m only within the period of 50% or more and 85% or less and had a tension simulated using the same high-stiffness spring as that used in the experiment under the Constant conditions within the other period (hereinafter represented as "Variable").

In FIG. 8B, the dashed line indicates a result obtained when motor control was performed so that the second wire 301 operated to simulate a spring having a stiffness of 200 N/m only within the period of 50% or more and 85% or less and had a tension simulated using the same high-stiffness spring as that used in the experiment under the Constant conditions within the other period (hereinafter represented as "Variable").

Thus, the graphs illustrated in FIG. 8A and FIG. 8B indicate that the differences between the solid lines and the dashed lines are relatively large in the period of 50% or more and 85% or less.

Additionally, a result further obtained through the functional sensory evaluation of the user 1 indicates that the difference in the sense of the user 1 between walking assistance based on motor control under the Constant conditions (the solid lines in FIG. 8A and FIG. 8B) and walking assistance based on motor control under the Variable conditions (the dashed lines in FIG. 8A and FIG. 8B) is largest within the swing phase.

FIG. 13 illustrates results of the measurement of the metabolic rate of the user 1 in term of energy during walking by using the breathing of the user 1. In FIG. 13, high metabolic rate in terms of energy indicates large energy expenditure. In FIG. 13, the metabolic rates of the user 1 in term of energy during walking in motor control under the Variable conditions and the Constant conditions are depicted, with the metabolic rate under the Constant conditions being represented as 100%.

Whereas the metabolic rate in term of energy under the Constant conditions was 100%, the metabolic rate in term of energy under the Variable conditions was 82.6%. This indicates that the energy consumed in the experiment under the Variable conditions is less than the energy consumed in the experiment under the Constant conditions.

The walking assistance in the experiment under the Variable conditions allows the user 1 to walk with less energy expenditure than walking assistance in the experiment under the Constant conditions. This indicates that the walking assistance in the experiment under the Variable conditions is more effective.

The experimental results described above indicate that walking assistance such that a tension simulated using a spring having lower stiffness is generated during the period of 50% or more and 85% or less than during the other period is desirable for appropriate walking assistance.

Figure 9:
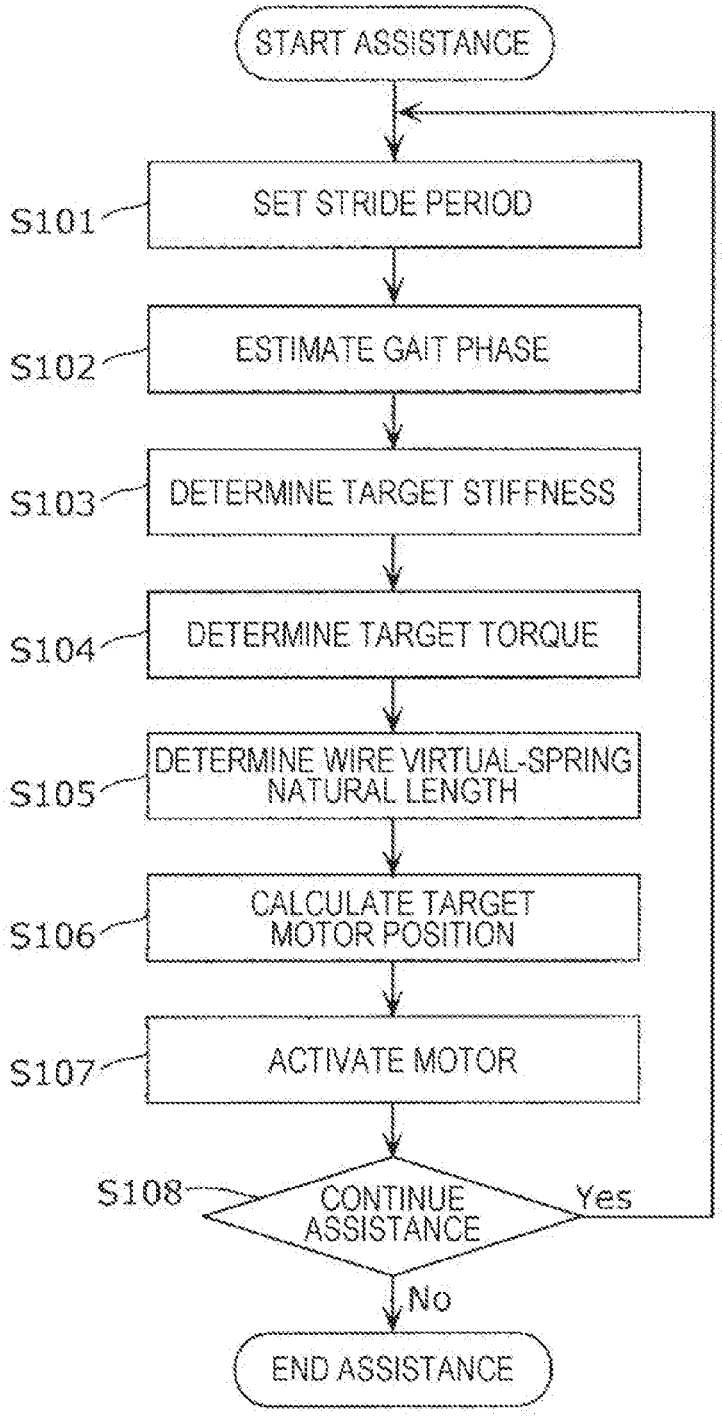
FIG. 9 is a flowchart illustrating the operation of the walking assistance apparatus according to the embodiment.

FIG. 9 is a flowchart illustrating the operation of the walking assistance apparatus 100. FIG. 9 illustrates the walking assistance operation for the right leg. The walking assistance operation for the left leg can also be described in a similar way.

Step S101

The controller 500 acquires gait information from a sensor, sets a stride period T of the right leg in accordance with the gait information, and outputs the stride period T.

Step S102

The controller 500 estimates the current gait phase of the right leg in accordance with information on the stride period T of the right leg.

Step S103

The controller 500 determines the target stiffnesses of the first wire 300*a* and the second wire 301*a*. The target stiffnesses are each determined to be greater than or equal to a predetermined value (e.g., 200 N/m) during a period (corresponding to the first period) including a period of 95% or more and 100% or less of a first gait cycle of the right leg and a period of 0% or more and 50% or less of a second gait cycle of the right leg, which is subsequent to the first gait cycle of the right leg.

Step S104

The controller 500 causes the target torque determination unit 13 to determine a target joint torque value t to be generated by each of the first wire 300*a* and the second wire 301*a* in accordance with the percentage of the gait phase of the right leg.

Step S105

The controller 500 causes the virtual spring natural length calculation unit 14 to determine a wire virtual-spring natural length $N_1$, which is simulated by the first wire 300*a*, and a wire virtual-spring natural length $N_2$, which is simulated by the second wire 301*a*, in accordance with the respective target joint torque values $\tau$ to be generated by the first wire 300*a* and the second wire 301*a* and the target wire stiffness values $K_1$ and $K_2$.

Step S106

The controller 500 performs force control calculation based on the target stiffnesses of the first wire 300*a* and the second wire 301*a*, which are determined in step S103, the wire virtual-spring natural lengths determined in step S105, and the respective motor torques for the motor corresponding to the first wire 300*a* and the motor corresponding to the second wire 301*a* among the motors 400, which are obtained at the current time point, and determines a control signal including a motor position value signal.

Step S107

Among the motors 400, the motor corresponding to the first wire 300*a* and the motor corresponding to the second wire 301*a* change the tensions of the first wire 300*a* and the second wire 301*a* in accordance with the motor control signal determined by the controller 500 in step S106.

Step S108

The controller 500 determines whether to continue walking assistance. If it is determined that the walking assistance continues (Yes in step S108), the process returns to step S101, or, otherwise (No in step S108), the walking assistance ends.

Figure 10:
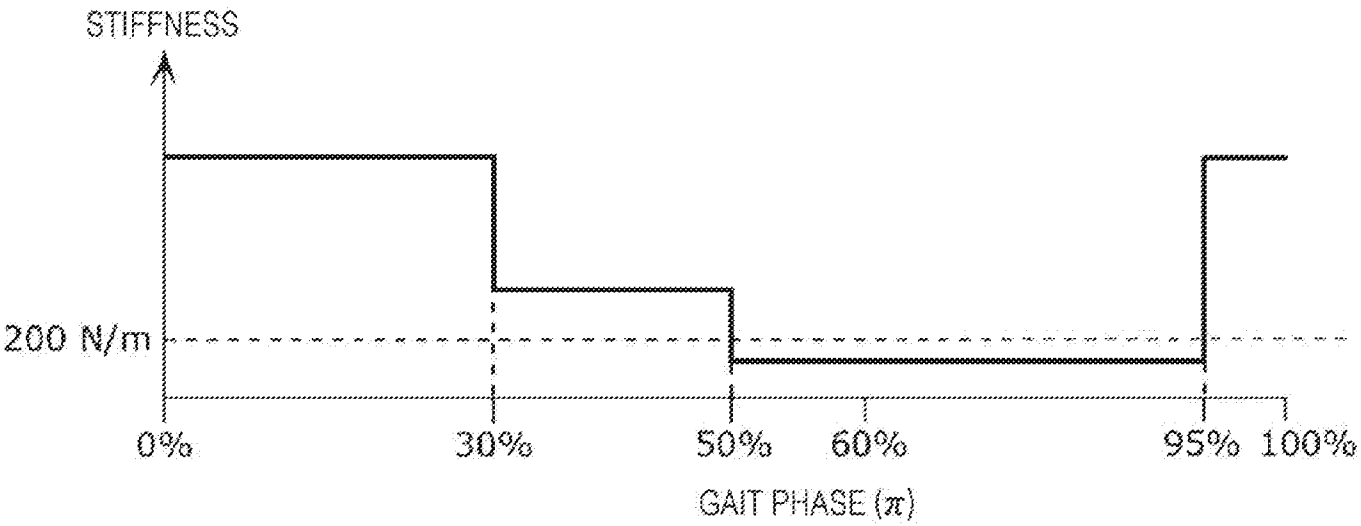
FIG. 10 is a timing chart illustrating a time change in the stiffness of first wires and the second wires according to the embodiment.

The following describes the processing of step S103 in more detail. FIG. 10 is a timing chart illustrating a time change in the stiffness of the first wire 300*a* and the second wire 301*a* according to this embodiment.

The controller 500 sets the stiffness setting value to be a value larger than 200 N/m at the time of 95% of the gait cycle of the right leg. This setting is made in order to assist the user 1 when the user 1 touches the ground, at which the leg stiffness of the person is highest.

Then, at the time of 30% of the gait cycle of the right leg, the controller 500 sets a stiffness greater than 200 N/m and less than the value set at the time of 95%. This setting moderates the change in stiffness at the swing phase (less than or equal to 200 N/m) without impairing the effect of assisting in providing stiffness during the stance phase.

Finally, the controller 500 sets the stiffness to a value less than or equal to 200 N/m at the time of 50% of the gait cycle of the right leg. The reason for reducing the stiffness at this timing is that the opposite foot, which is the left foot (i.e., the foot in the air), makes contact with the ground at the time of 50% and no need exists for one leg to support the weight of the body. Another reason is to smoothly move the leg forward during the swing phase (the period of 60% or more and 100% or less of the gait cycle of the right leg).

The value of stiffness of a virtual spring simulated by a wire is the largest during a continuous period including the period of 95% or more and 100% or less of the gait cycle of the right leg and the period of 0% or more and 30% or less of the next gait cycle of the right leg and is the second largest during the period of 30% or more and 50% or less of the gait cycle of the right leg. The value of stiffness of a virtual spring simulated by a wire is the smallest (a value less than or equal to 200 N/m) during the period of 50% or more and 95% or less of the gait cycle of the right leg. The controller 500 controls each of the motors 400 in accordance with the corresponding value of stiffness, thereby enabling the first wire 300*a* and the second wire 301*a* to generate tensions that simulate the respective stiffness values. This can effectively assist a person in walking.

First Modification of Embodiment

The following describes a modification in which a controller is arranged outside a walking assistance apparatus.

Figure 11:
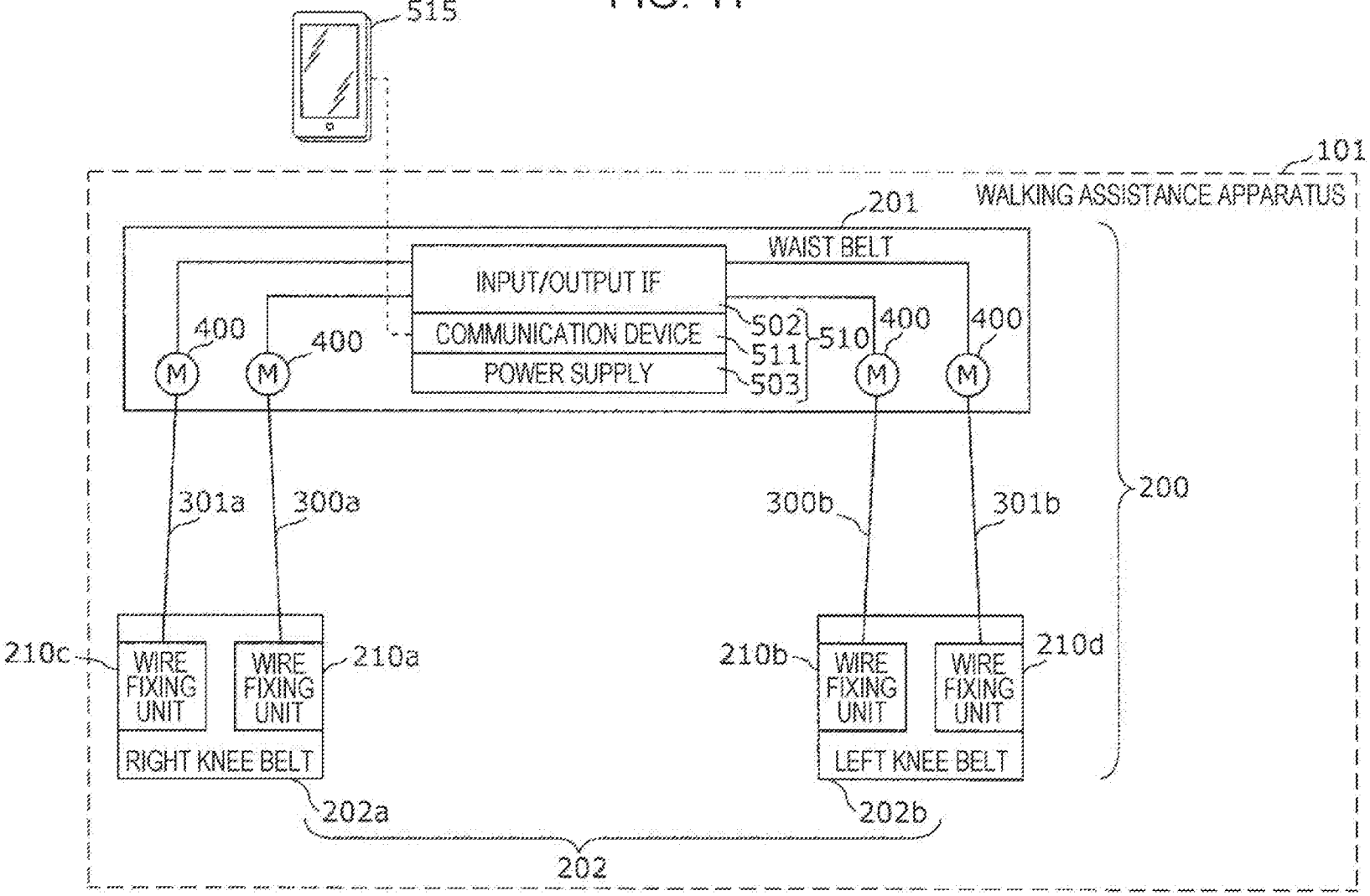
FIG. 11 illustrates a walking assistance apparatus according to a first modification of the embodiment.

FIG. 11 illustrates an example in which a processing unit corresponding to the controller 500 according to the embodiment is located in a device (external device) outside a walking assistance apparatus 101. An example of the external device is a smartphone 515. The smartphone 515 includes a sensor to measure a stride period.

In the smartphone 515, a processor executes a predetermined program to implement the functions of the control circuit 501 according to the embodiment. The smartphone 515 outputs a control signal for controlling the motors 400 to a controller 510 via wireless or wired communication.

The walking assistance apparatus 101 includes the suit 200, the first wire 300*a*, the first wire 300*b*, the second wire 301*a*, the second wire 301*b*, the motors 400, and the controller 510.

The controller 510 includes the input/output IF 502, the power supply 503, and a communication device 511. The controller 510 controls the motors 400 in accordance with a control signal acquired from the external device.

More specifically, the controller 510 receives a control signal for the motors 400, which is output from the smartphone 515, at the communication device 511 and controls the motors 400 via the input/output IF 502. Information on the positions and torques of the motors 400 is input from the input/output IF 502 and is output to the smartphone 515 via the communication device 511.

That is, the smartphone 515 and the communication device 511 function as the control circuit 501 according to the embodiment. This configuration enables the walking assistance apparatus 101 according to this modification to implement functions similar to those of the walking assistance apparatus 100 according to the embodiment. Since the control operation is performed in accordance with a program running on the smartphone 515, there is an advantage in that maintenance of the program, such as update, is facilitated.

Second Modification of Embodiment

Figure 12:
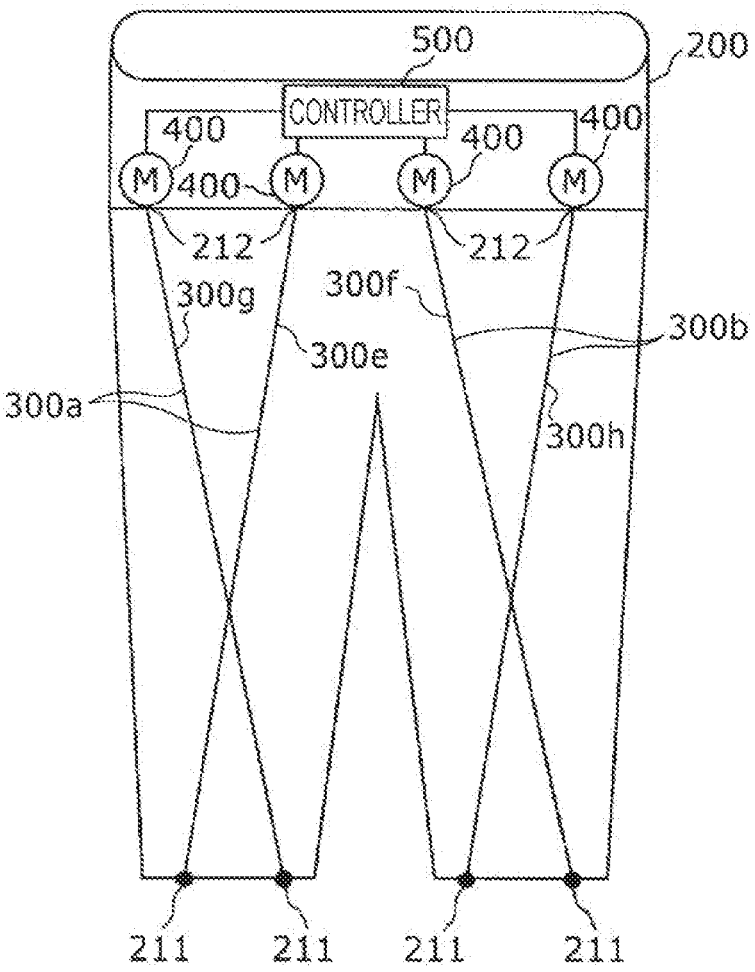
FIG. 12 illustrates a walking assistance apparatus according to a second modification of the embodiment.

FIG. 12 illustrates an example of the suit 200. The suit 200 illustrated in FIG. 12 is in the form of pants with functions of the waist belt 201 and the knee belts 202*a* and 202*b*.

Also when the suit 200 is in the form of pants, it is desirable that the first wire 300*a* and the first wire 300*b* be fixedly located in the first portion 211 and the second portion 212, and the first wire 300*a* and the first wire 300*b* may be stitched into the suit 200. It is also desirable that the second wires 301*a* and 301*b* couple the third portion 213 and the fourth portion 214 to each other, and the second wires 301*a* and 301*b* may be stitched into the suit 200. Furthermore, the first wires 300*a* and 300*b* and the second wires 301*a* and 301*b* are not necessarily each a single wire. As illustrated in FIG. 12, the first wires 300*a* and 300*b* and the second wires 301*a* and 301*b* may be each implemented as multiple wires. In the example illustrated in FIG. 12, the suit 200 includes four first wires 300*e*, 300*f*, 300*g*, and 300*h*.

The suit 200 according to this modification is convenient to use since the user 1 can wear the suit 200, which is a walking assistance apparatus, in a way similar to that in which the user 1 wears normal clothes. When wires are stitched into the suit 200, the wires are not externally exposed, which advantageously prevents the wires from interfering with or contacting the body of the user 1, clothes, or other objects.

In the embodiment and modifications described above, each of the constituent elements may be implemented by dedicated hardware or may be implemented by executing a software program suitable for the constituent element. Each constituent element may be implemented by a program execution unit such as a central processing unit (CPU) or a processor reading and executing a software program recorded on a recording medium such as a hard disk or a semiconductor memory.

While a walking assistance apparatus and the like according to one or more aspects of the present disclosure have been described with reference to an embodiment, the present disclosure is not limited to this embodiment. Various modifications conceivable to a person skilled in the art may be made to this embodiment and constituent elements in different embodiments may be combined into other embodiments without departing from the gist of the present disclosure. Such modifications and embodiments may also be included in the scope of one or more aspects of the present disclosure.

A walking assistance apparatus according to an embodiment of the present disclosure is suitable for use to assist an injured or sick user in walking, assist a user in walking when they are fatigued, or assist the elderly in walking, for example.

What is claimed is:

1. A walking assistance apparatus comprising:

a suit configured to be worn on a knee and a waist of a user;

a first wire that couples a portion that is included in the suit and configured to be worn above the knee of the user to a portion that is included in the suit and configured to be worn on the waist of the user;

a second wire that couples a portion that is included in the suit and configured to be worn above a back of the knee of the user to a portion that is included in the suit and configured to be worn on the waist of the user;

motors coupled to the first wire and the second wire, the motors and the first wire and the second wire being in a one-to-one relationship; and a controller configured to control the motors to generate tensions in the first wire and the second wire so that each of the first wire and the second wire has a stiffness greater than 200 N/m during a first period, the first period including (i) a period of 95% or more and 100% or less of a first gait cycle of the user and (ii) a period of 0% or more and 50% or less of a second gait cycle subsequent to the first gait cycle to thereby assist in supporting weight on a leg including the knee when the leg is in contact with a ground, the first gait cycle and the second gait cycle being consecutive, and wherein the second gait cycle includes a stance phase and a swing phase, and a period of the stance phase is a period of 0% or more and 60% or less of the second gait cycle.

2. The walking assistance apparatus according to claim 1, wherein the controller comprises a control circuit configured to:

acquire the first gait cycle and the second gait cycle, and output control signals to the motors for generating the tensions.

3. The walking assistance apparatus according to claim 1, wherein the motors are configured to generate the tensions by winding or unwinding the first wire and the second wire.

4. The walking assistance apparatus according to claim 1, wherein the controller is further configured to control the motors to generate the tensions in the first wire and the second wire so that each of the first wire and the second wire has a stiffness less than or equal to 200 N/m during a second period of 50% or more and 95% or less of the first gait cycle of the user.

5. The walking assistance apparatus according to claim 1, wherein the controller is further configured to control the motors to adjust the tensions in the first wire and the second wire so that the stiffness of each of the first wire and the second wire is reduced from a first stiffness during a third period to a second stiffness during a fourth period of 30% or more and 50% or less of the second gait cycle, the third period including (i) the period of 95% or more and 100% or less of the first gait cycle of the user and (ii) a period of 0% or more and 30% or less of the second gait cycle, the second stiffness being lower than the first stiffness so that a stiffness change during the swing phase is moderated without impairing assistance to the user.

6. A method for controlling a walking assistance apparatus, the walking assistance apparatus including a suit to be worn on a knee and a waist of a user, a first wire that couples a portion that is included in the suit and worn above the knee of the user to a portion that is included in the suit and worn on the waist of the user, a second wire that couples a portion that is included in the suit and worn above a back of the knee of the user to a portion that is included in the suit and worn on the waist of the user, motors coupled to the first wire and the second wire, and a control circuit, the motors and the first wire and the second wire being in a one-to-one relationship, the method comprising:

acquiring, by the control circuit, a first gait cycle of the user and a second gait cycle subsequent to the first gait cycle, the first gait cycle and the second gait cycle being consecutive; and outputting, by the control circuit, control signals to the motors for causing the motors to generate tensions in the first wire and the second wire so that each of the first wire and the second wire has a stiffness greater than 200 N/m during a first period, the first period including (i) a period of 95% or more and 100% or less of the first gait cycle and (ii) a period of 0% or more and 50% or less of the second gait cycle to thereby assist in supporting weight on a leg including the knee when the leg is in contact with a ground, wherein the second gait cycle includes a stance phase and a swing phase, and a period of the stance phase is a period of 0% or more and 60% or less of the second gait cycle.

7. The method according to claim 6, wherein the motors generate the tensions by winding or unwinding the first wire and the second wire.

8. The method according to claim 6, wherein the motors generate the tensions in the first wire and the second wire so that each of the first wire and the second wire has a stiffness less than or equal to 200 N/m during a second period of 50% or more and 95% or less of the first gait cycle of the user.

9. The method according to claim 6, wherein the control circuit controls the motors to adjust the tensions in the first wire and the second wire so that the stiffness of each of the first wire and the second wire is reduced from a first stiffness during a third period to a second stiffness during a fourth period of 30% or more and 50% or less of the second gait cycle, the third period including (i) the period of 95% or more and 100% or less of the first gait cycle of the user and (ii) a period of 0% or more and 30% or less of the second gait cycle, the second stiffness being lower than the first stiffness so that a stiffness change during the swing phase is moderated without impairing assistance to the user.

10. A walking assistance apparatus comprising:

a wire including a first end and a second end;

a motor to which the second end is coupled;

a suit including a first portion coupled to the first end at a first position and a second portion, a portion of the wire being in contact with the second portion at a second position; and a controller, wherein the suit is configured such that:

when a user wears the suit, the first portion is in contact with a first part of a body of the user at the first position and the second portion is in contact with a second part of the body of the user at the second position, the second part being a portion at a waist of the user, when a user wears the suit, the first part is included in a thigh of the user and is closer to a knee of the user than to a hip joint of the user but is not included in the knee, when a user wears the suit, the first part and the second part are located on a front surface of the body of the user, the first portion is made of a continuous member and the second portion is made of a continuous member, and the motor is located in the second portion, wherein the controller is configured to control the motor to wind the wire during a first period to thereby generate a stiffness greater than 200 N/m in the wire, the first period including (i) a period of 95% or more and 100% or less of a first gait cycle of the user and (ii) a period of 0% or more and 50% or less of a second gait cycle subsequent to the first gait cycle to thereby assist in supporting weight on a leg including the knee when the leg is in contact with a ground, the first gait cycle and the second gait cycle being consecutive, and wherein the second gait cycle includes a stance phase and a swing phase, and a period of the stance phase is a period of 0% or more and 60% or less of the second gait cycle.

* * * * *